United States Patent [19]

Blomsterberg

[11] 4,269,677

[45] May 26, 1981

[54] ANODIC DEBURRING OR BRIGHTENING OF STEEL ARTICLES

[76] Inventor: Karl-Ingemar Blomsterberg, Högstensgatan 60, S-423 00 Torslanda, Sweden

[21] Appl. No.: 121,680

[22] Filed: Feb. 15, 1980

[30] Foreign Application Priority Data

Feb. 19, 1979 [SE] Sweden ..... 7901437

[51] Int. Cl.[3] ..... C25F 3/06; C25F 3/24

[52] U.S. Cl. ..... 204/129.4; 204/129.43; 204/129.85; 204/129.95; 204/DIG. 9

[58] Field of Search ..... 204/129.75, 129.8, 129.85, 204/129.43, 129.95, DIG. 9

[56] References Cited

U.S. PATENT DOCUMENTS

| | | | |
|---|---|---|---|
| 2,947,674 | 8/1960 | Andrisek et al. | 204/129.4 |
| 3,006,827 | 10/1961 | Capuano | 204/129.75 X |
| 3,489,660 | 1/1970 | Semienko et al. | 204/129.95 X |
| 3,556,957 | 1/1971 | Toledo et al. | 204/129.95 X |

FOREIGN PATENT DOCUMENTS

| | | | |
|---|---|---|---|
| 51-5824 | 2/1976 | Japan | 204/129.75 |
| 197709 | 9/1977 | U.S.S.R. | 204/129.75 |

*Primary Examiner*—R. L. Andrews
*Assistant Examiner*—D. R. Valentine

[57] ABSTRACT

Anodic deburring or brightening of steel articles is carried out in an alkaline solution containing, per liter of the solution, at least 200 grams of water, at least 300 grams of polyhydric alcohol and at least 200 grams of alkali sulphamate.

10 Claims, No Drawings

ANODIC DEBURRING OR BRIGHTENING OF STEEL ARTICLES

BACKGROUND OF THE INVENTION

This invention relates to a method of deburring and/or polishing a steel article. More particularly, the invention relates to a method of deburring and/or polishing a steel article which comprises subjecting said article as the anode to the action of a direct current in an electrolyte containing, in addition to one or more electrolytically active (that is, ionizable) constituents, at least one polyhydric alcohol for controlling the viscosity of the bath. The method involves the use of a bath voltage (that is, a voltage between the anode and the cathode) in the range of 4 to 25 volts and a current density in the range of 2 to 50 amperes per square decimeter.

A deburring method of the kind above set out is required to produce a satisfactory burr removing action while removing as little material as possible from the even areas of the article. In electrolytic polishing (also referred to as electrolytic brightening), some slight removal of material from the surface of the article is, of course, unavoidable. The articles treated should present a uniform and attractive appearance throughout their surface, with no remaining roughness.

The practical applicability of the method and the total costs of the treatment very much depend on the extent to which various practical desiderata can be satisfied. The time required for the treatment of an article should be short. The useful life of the bath solution should be long. The bath temperature required should not be undesirably high, preferably not substantially in excess of room temperature. The bath as well as the vapours given off thereby should not be poisonous or otherwise constitute a health hazard. Spent bath liguids should be disposable simply and cheaply.

Known methods of the general kind above specified entail the use of baths containing substantial proportions of one or more strong acids. Baths of this kind, being strongly erosive and dangerous, require a well-trained personnel as well as shops equipped with facilities for the exhausting and neutralizing of the escaping vapours. Also, the useful life of the baths is comparatively short.

The present invention has for its general object to provide a method of the kind above specified and a bath composition therefor, which have improved properties in at least some of the respects above referred to. A more special object is the provision of a method and an electrolyte bath therefor which require a minimum of safety measures and which can be handled by personnel having no or little special training. Still another object is the provision of a bath which has a long useful life and, when spent, can be disposed of easily.

SUMMARY OF THE INVENTION

The new method according to the invention is principally characterized thereby that the treatment is carried out in an electrolyte consisting of an alkaline watery solution composed essentially of at least one polyhydric alcohol, alkali sulphamate and water in the following proportions:

| | Grams per litre of the solution: |
|---|---|
| Polyhydric alcohol | At least 300 |

-continued

| | Grams per litre of the solution: |
|---|---|
| Alkali sulphamate | At least 200 |
| Water | At least 200 |

In a preferred form of the invention, the solution additionally contains a minor quantity of a chloride, preferably an alkali chloride, said quantity being small compared to the quantity of alkali sulphamate. Preferably the quantity of chloride present in the solution amounts to not less than 2 grams per liter and not more than 30 grams per liter.

For deburring steel articles by the method of the invention, the bath voltage should preferably not exceed 15 volts, a voltage within the range of 4 to 15 volts being preferred, and the current density (at the surface of the anode) should not exceed 25 amperes per square decimeter, a current density between about 3 and about 20 amperes per square decimeter being preferred. The temperature of the bath should not exceed 30° or 35° centigrade and preferably be maintained within the range of 20° to 30° centigrade.

A substantial reduction of the time required for the treatment according to the invention can be realized by operating the method intermittently, that is, by supplying the operating current during periods separated by idle intervals during which no current is supplied. The length of the current periods should preferably be of the order ½ to 1 minutes. The length of the idle interval should be a few seconds only, for instance 5 to 10 seconds.

DESCRIPTION OF A SPECIFIC FORM OF THE INVENTION

A specific example of an electrolyte bath for the method according to the invention is composed as follows:

Sodium sulphamate—500 grams
Glycerol—700 grams
Water—500 grams
Sodium chloride—15 grams
pH 10 to 12

For electrolytic (anodic) deburring of steel articles in this bath, the following conditions are employed:

Bath temperature—20° to 30° centigrade
Bath voltage—4 to 15 volts
Current density (at the anode) 3 to 8 amperes per $dm^2$ Preferably the treatment is carried out intermittently, with current periods of ½ to 1 minutes and idle intervals of 5 to 10 seconds.

Adjustment of the pH of the bath is carried out by the addition of diluted sodium hydroxide solution (or water, if a reduction of the pH should be required).

The bath is believed to function in substantially the following manner. The sulphamate ion delivers its electric charge to the anode (that is, the steel article to be deburred), resulting in the formation of sulphamic acid and oxygen. The oxygen oxidizes the iron to ferrous oxide (FeO) forming a very thin layer on the article. This action is due to the high salt content and the high content of polyhydric alcohol of the solution. The layer of iron oxide serves to protect the iron against attack by the sulphamate acid. The iron oxide layer is extremely thin at sharp edges which are also subjected to an intensified electric field (the "point effect"). The chlorine ions present in the electrolyte also tend to discharge at the anode to form free chlorine. Said discharge is, however, obstructed by the layer of iron oxide and by the high sulphamate ion concentration. The free chlorine therefor tends to appear principally at the spots where the oxide layer is at its thinnest and the electric field strength is large, that is, at burrs on other sharp edges. The chlorine destroys the thin layer of oxide and attacks the iron, combining with the iron into iron chloride, $FeCl_3$. The trivalent iron is reduced to bivalent iron in the alkaline solution and is precipitated on the cathode. In this way, the electrode is cleared continuously of dissolved anode metal, resulting in a long useful life. Other solid impurities can be separated continuously from the bath, for instance by means of filtering means.

When the bath finally is spent, it only has to be diluted with water prior to its discharge into the drains or into any other recipient. The dilution causes the dissolved bivalent iron to be oxidized into trivalent iron. More particularly, the alkalinity of the bath will cause iron hydroxide $Fe(OH)_3$ to be formed. If desired, the iron hydroxide can easily be separated from the liquid.

The method according to the invention has the additional advantage of imparting to the articles treated a certain degree of passivity providing a temporary protection against rusting.

I claim:

1. A method of electrolytically deburring or polishing a steel article which comprises subjecting said article as the anode to the action of a direct current in an electrolyte at an anode-cathode voltage between 4 and 25 volts and a current density between 2 and 50 amperes per square decimeter, said electrolyte consisting of an alkaline watery solution composed essentially of at least one polyhydric alcohol, alkali sulphamate and water in the following proportions:

| | Grams per liter of the solution: |
|---|---|
| Polyhydric alcohol | At least 300 |
| Alkali sulphamate | At least 200 |
| Water | At least 200. |

2. A method as claimed in claim 1 in which the treatment is carried out in a solution containing, in addition to the components specified, a minor proportion of chloride.

3. A method as claimed in claim 1 or 2 in which the current is supplied during a plurality of successive periods separated by idle intervals during which no current is supplied.

4. A method as claimed in claim 1 or 2 in which the current is supplied during a plurality of periods, each of which has a duration of not less than 30 and not more than 60 seconds, separated by idle intervals each of which has a duration of 5 to 10 seconds.

5. A method as claimed in claim 1 in which the electrolyte bath is kept at a temperature of 20° to 30° centigrade.

6. A method as claimed in claim 1 in which the pH of the electrolyte bath is maintained between 9 and 12.

7. An electrolyte bath for the anodic deburring or polishing of a steel article consisting of an alkaline watery solution composed essentially of at least one polyhydric alcohol, alkali sulphamate and water in the following proportions:

| | Grams per liter of the solution: |
|---|---|
| Polyhydric alcohol | At least 300 |
| Alkali sulphamate | At least 200 |
| Water | At least 200. |

8. An electrolyte bath as claimed in claim 7 having an alkali content resulting in a pH between 9 and 12.

9. An electrolyte bath as claimed in claim 7 which additionally contains one or more soluble chlorides in a total quantity amounting to between 2 and 30 grams per liter.

10. An electrolyte bath for the anodic deburring or polishing of a steel article composed of

| | Parts by weight |
|---|---|
| Sodium sulphamate | 500 |
| Glycerol | 700 |
| Water | 500 |
| Sodium chloride | 15 |
| Alkali | as required to provide a pH between 9 and 12. |

* * * * *